US008973192B2

(12) United States Patent
Miller

(10) Patent No.: US 8,973,192 B2
(45) Date of Patent: Mar. 10, 2015

(54) COLLAPSIBLE MOBILITY ASSISTANCE DEVICE

(75) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 513 days.

(21) Appl. No.: 13/105,688

(22) Filed: May 11, 2011

(65) Prior Publication Data

US 2012/0117926 A1 May 17, 2012

Related U.S. Application Data

(60) Provisional application No. 61/333,962, filed on May 12, 2010.

(51) Int. Cl.

| | |
|---|---|
| ***A61G 7/16*** | (2006.01) |
| ***A61G 7/10*** | (2006.01) |
| ***A47C 21/08*** | (2006.01) |
| ***A61H 3/00*** | (2006.01) |

(52) U.S. Cl.

CPC ..... *A61G 7/1038* (2013.01); *A47C 21/08* (2013.01); *A61H 3/00* (2013.01)

USPC ..... 5/662; 5/81.1 R

(58) Field of Classification Search

USPC ..... 5/662, 424, 425, 426, 430, 81.1 R

See application file for complete search history.

(56) References Cited

U.S. PATENT DOCUMENTS

| | | | | |
|---|---|---|---|---|
| 3,739,793 | A | 6/1973 | Wilson | |
| 5,400,450 | A | 3/1995 | Leoutsakos | |
| 5,471,689 | A | 12/1995 | Shaw et al. | |
| 6,134,731 | A | 10/2000 | Thom et al. | |
| 6,401,280 | B1 | 6/2002 | Baker | |
| 6,813,789 | B2 | 11/2004 | Leoutsakos | |
| 7,028,354 | B2 | 4/2006 | Nygren et al. | |
| 7,032,265 | B2 | 4/2006 | Miller | |
| 7,103,928 | B1 | 9/2006 | Childs | |
| 7,197,779 | B2 | 4/2007 | Shalikar | |
| 7,237,285 | B2 | 7/2007 | Brewin et al. | |
| 7,373,679 | B2 | 5/2008 | Miller | |
| 2005/0187083 | A1* | 8/2005 | Krystoff | 482/140 |
| 2006/0162753 | A1 | 7/2006 | Grana et al. | |
| 2008/0161162 | A1 | 7/2008 | Dokshutsky | |
| 2009/0029784 | A1* | 1/2009 | Gregorian | 472/109 |
| 2011/0185507 | A1* | 8/2011 | Abernathey et al. | 5/662 |

OTHER PUBLICATIONS

International Search Report and Written Opinion for PCT/US2011/036103 dated Nov. 30, 2011.

Wheelchairs Plus Mobility Solutions, Inc. http://www.amazon.com/Travel-Handles-Bedside-Assistant-travel/dp/Boo19HMTRO/ref=sr_1_1?ie=UTF8&s=hpc&qid=1273502552&sr=8-1. Accessed Sep. 16, 2011.

* cited by examiner

*Primary Examiner* — Peter M Cuomo

*Assistant Examiner* — Brittany Wilson

(74) *Attorney, Agent, or Firm* — Stoel Rives LLP

(57) ABSTRACT

A collapsible mobility assistance device which may be configured in an operable configuration and a storage configuration. The device may be configured such that each individual component is planar, which may allow the device to be packaged, stored, and/or shipped in minimally sized containers.

20 Claims, 7 Drawing Sheets

COLLAPSIBLE MOBILITY ASSISTANCE DEVICE

RELATED APPLICATION

This utility application claims priority to, and hereby incorporates by reference, U.S. Provisional Application 61/333,962, filed on May 12, 2010, entitled "Collapsible Mobility Assistance Device."

TECHNICAL FIELD

The present disclosure relates generally to mobility assistance devices. More specifically, the present disclosure relates to assistance devices, such as bed rail devices, which may assist individuals in positioning themselves onto and securing themselves in beds or on similar furniture.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Figure 1:
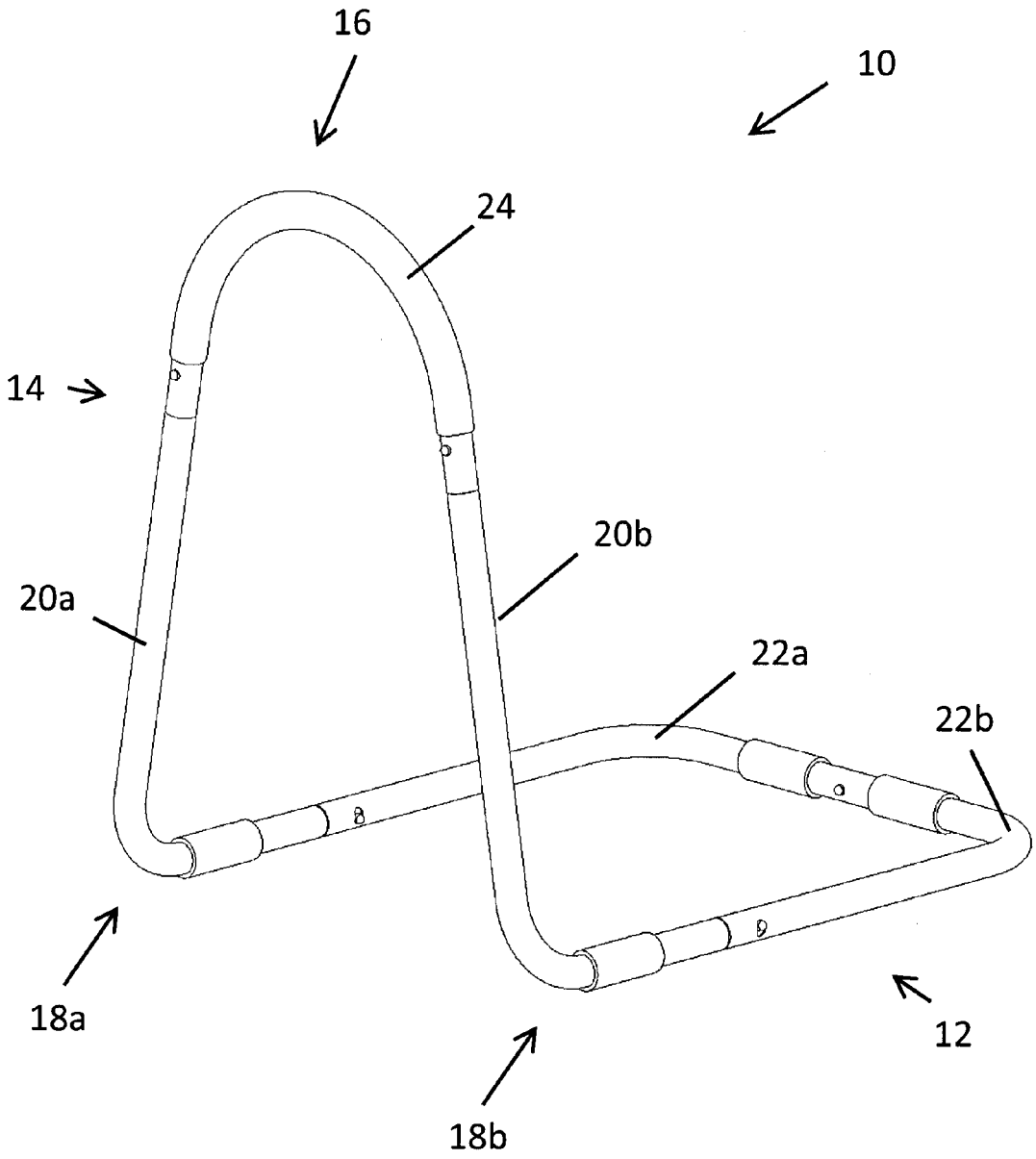
FIG. 1 is a perspective view of one embodiment of a collapsible mobility assistance device in an operative configuration.

Mobility assistance devices may generally refer to pieces of medical equipment used to assist individuals with disabilities and/or other infirmities, including conditions incident to accidents, disease, age, or other causes. Mobility assistance devices may be designed to help individuals get into and out of reclining, sitting, and/or prone positions. For example, a mobility assistance device may be coupled to a bed or other piece of furniture designed for one to sit, lie down, or sleep upon. Furthermore, mobility assistance devices, such as bed rails, may also secure an individual in or on a piece of furniture, such as a bed, such that the individual is less likely to accidentally fall off the piece of furniture. Mobility assistance devices may be used in various environments, including in connection with a bed as a bed rail device.

In some instances, manufacturers of mobility assistance devices may desire to compactly package the devices for mass retail sale. Likewise, retailers may desire compact device storage to aid in optimizing profit per retail space, as products which are packaged in bulky containers, yet have a relatively small profit margin, may negatively impact profit per retail space.

Some mobility assistance devices are comprised of two sections: a base section and an upright section. The base section may form a plane configured to couple to a piece of furniture; for example, the base section may be configured to fit between a mattress or cushion and the support frame of a piece of furniture, such as between the mattress and box springs or foundation of a bed. The upright section may form a plane which is substantially perpendicular to the base, and may include a handle configured to be graspable by a user. Each of these sections may be sized so as to provide sufficient support for the intended function of the mobility assistance device. In some embodiments, each section may be quite large. Accordingly, mobility assistance devices may be packaged in substantially bulky containers, thus potentially resulting in a negative impact on the profit per retail space of mass retailers that carry mobility assistance devices.

The present disclosure provides a collapsible mobility assistance device and method of packaging which may allow for decreased package size. The mobility assistance device of the present disclosure may collapse down to a plurality of pieces sized such that they may be packaged in flat, planar packaging having a thickness as small as the thickness of a single piece. The upright section may break down into two or more pieces and the base may break down into two or more pieces, such that, when all the pieces are arranged in the storage (packaged) configuration, no piece is stacked upon any other piece. Thus, in some embodiments the package may only have the thickness of a single piece of the mobility assistance device.

The present disclosure may also optimize the number of parts into which the mobility assistance device separates. Optimization is not necessarily reducing the size of the pieces (which could result in a corresponding increase in the number of pieces) in order for the mobility assistance device to maintain desired operational dimensions. While the disclosure may optimize the number of pieces, it is not limited to breaking the product into more pieces to achieve a smaller packaged form. Optimization broadly means minimizing the number of pieces while simultaneously achieving a minimally sized package; this may be accomplished by making the pieces in similar sizes, of in particular shapes, in certain embodiments.

It will be readily understood that the components of the embodiments, as generally described and illustrated in the figures herein, could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

The phrases "connected to," "coupled to," and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Referring generally and collectively to FIGS. 1-5, a collapsible mobility assistance device 10 may be disposed in, at least, an operative configuration and a storage (packaged) configuration. The mobility assistance device 10 depicted may be used in various environments, including with a bed as a bed rail device. In the illustrated embodiment, the collapsible mobility assistance device 10 comprises a base section 12 and an upright section 14.

The base section 12 may be separable into two base portions 22*a*, 22*b*. In some embodiments, the base portions 22*a*, 22*b* may be similarly sized. In some embodiments, the base section 12 may be configured to couple to device 10 to a piece of furniture, for example it may be configured to be disposed under a cushion-type portion of a piece of furniture.

The upright section 14 may include a handle 16, configured to be graspable by a user, which may be configured to support a user during movement. The upright section 14 may be separable into a plurality of pieces, including a handle portion 24, and two or more upright support portions 20*a*, 20*b*. In some embodiments, upright support portions 20*a*, 20*b* may be similarly sized. Moreover, in certain embodiments, the upright support portions 20*a*, 20*b* may also be similarly sized to the two base portions 22*a*, 22*b*. Similarly sizing each upright support portion 20*a*, 20*b* with each base portion 22*a*, 22*b* may allow for a desirable package shape or configuration.

Each upright support portion 20*a*, 20*b* may couple to the base section 12 such that the upright support portions 20*a*, 20*b* are disposed at an inclined angle in a plane substantially perpendicular to a plane defined by the base section 12. Further, the upright support portions 20*a*, 20*b* may each include a junction portion 18*a*, 18*b* adapted to couple the upright support portions 20*a*, 20*b* to the base portions 22*a*, 22*b*, thereby coupling upright section 14 to the base section 12. In the illustrated embodiment, the junction portions 18*a*, 18*b* include a substantially 90 degree elbow (or bend) configured to position the upright support portions 20*a*, 20*b* in a plane substantially perpendicular to a plane defined by the base portions 22*a*, 22*b*. In the embodiment shown, the junction portions 18*a*, 18*b* are coupled to the upright support portions 20*a*, 20*b*. In some embodiments, the junction portions 18*a*, 18*b* may be integrally formed with the upright support portions 20*a*, 20*b*.

In certain embodiments, the upright support portions 20*a*, 20*b* may be substantially disposed in a plane perpendicular to the base, while also being inclined toward one another within that plane, such that the upright support portions 20*a*, 20*b* are not parallel. Thus, in some embodiments, the distance between the upright support portions 20*a*, 20*b* may be smaller near the handle 16 than the distance between the upright support portions 20*a*, 20*b* near the base section 12. In some applications, such a design may provide stability for a user who applies pressure on the mobility assistance device.

In the illustrated embodiment, the junction portions 18*a*, 18*b* are located on the upright support portions 20*a*, 20*b*. In other embodiments, the junction portions 18*a*, 18*b* may alternatively be positioned on the base portions 22*a*, 22*b*. In still other embodiments, the junction portions 18*a*, 18*b* may be partially located on the upright support portions 20*a*, 20*b* and partially located on the base portions 22*a*, 22*b*.

Figure 2:
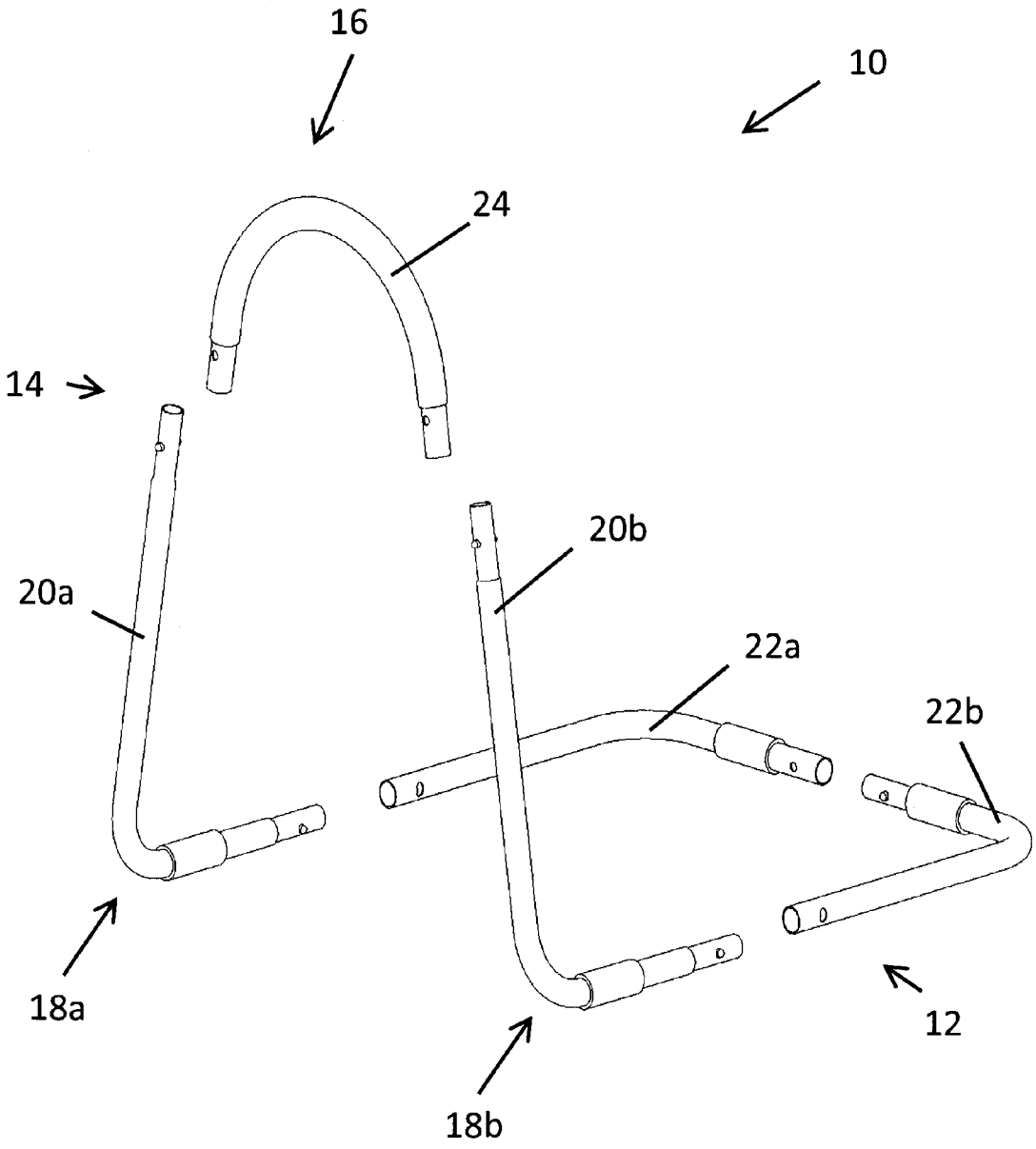
FIG. 2 is an exploded view of the collapsible mobility assistance device of FIG. 1.
Figure 4:
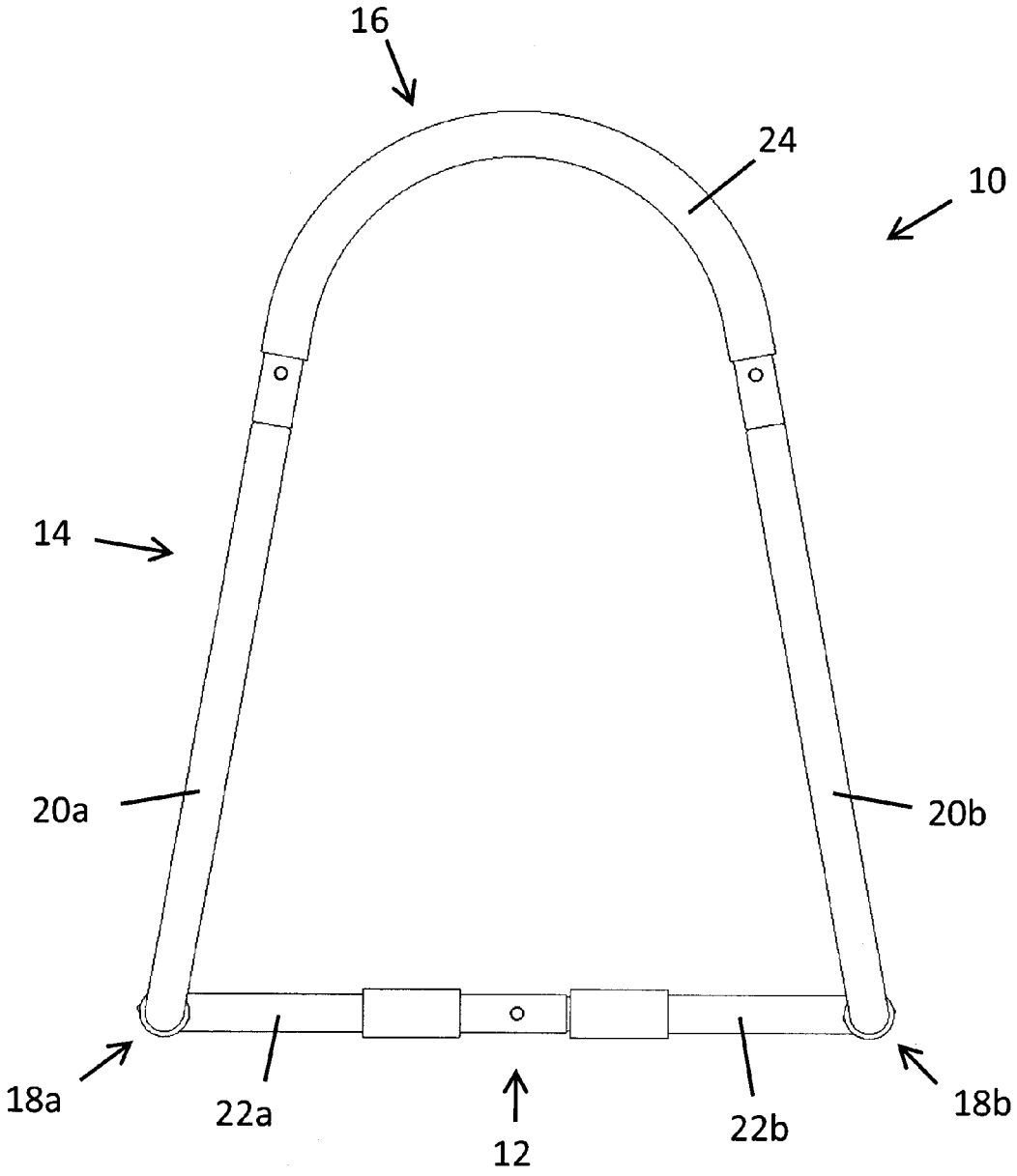
FIG. 4 is a front view of the collapsible mobility assistance device of FIG. 1.
Figure 5:
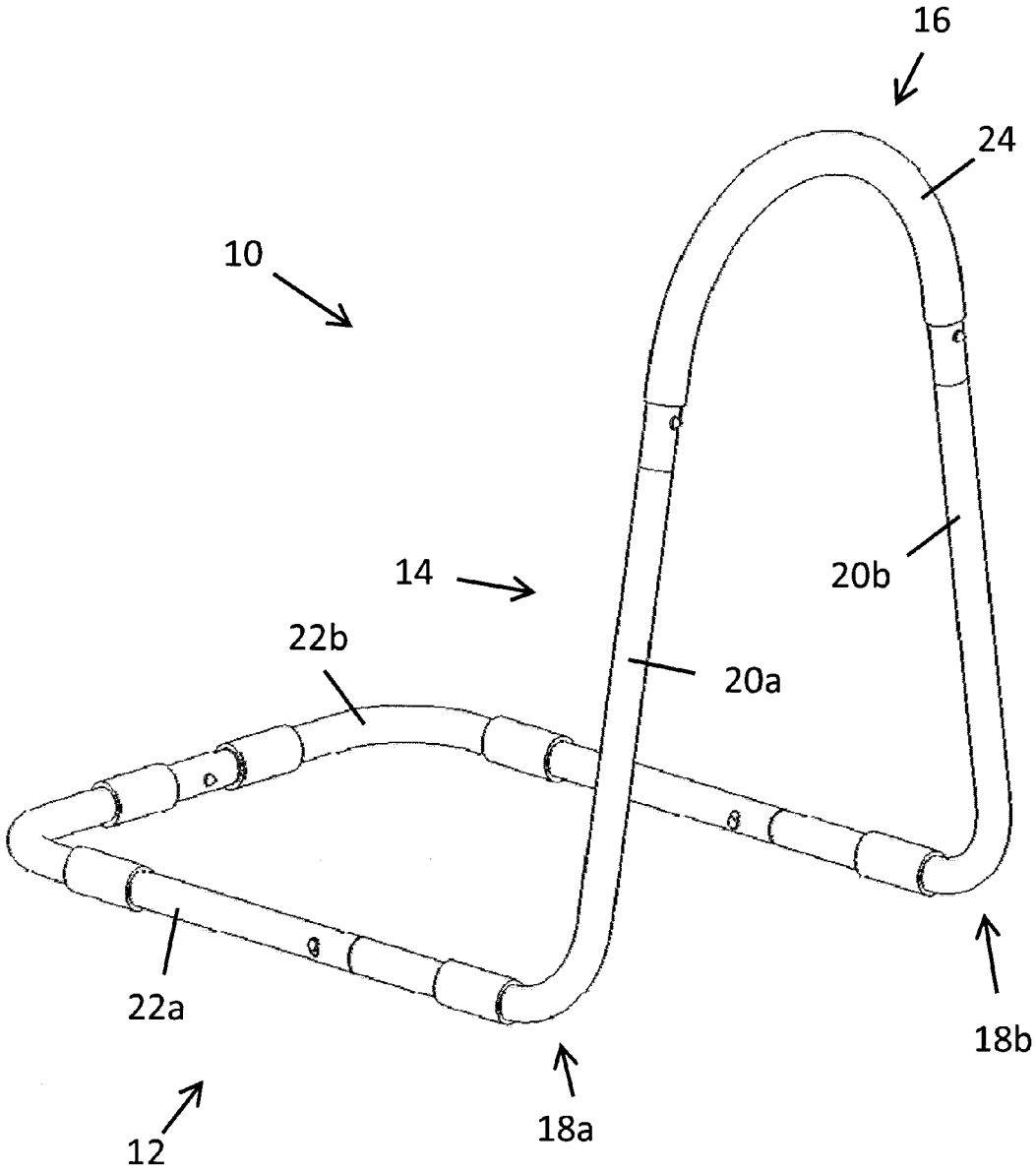
FIG. 5 is a perspective view of the collapsible mobility assistance device of FIG. 1.

FIGS. 1, 4, and 5 illustrate one embodiment of a mobility assistance device 10 in an operative configuration. As shown in FIG. 1, in the operative configuration, the handle portion 24 may couple to the upright support portions 20*a*, 20*b*. Further, the base portions 22*a*, 22*b* may couple together, and the upright support portions 20*a*, 20*b* may also couple to the base portions 22*a*, 22*b*. FIG. 2 illustrates each of these components decoupled from the others, yet substantially oriented as they would be in an operative configuration.

Any of the portions or components of the mobility assistance device 10 (for example, portions 20*a*, 20*b*, 22*a*, 22*b*, and 24) may be coupled together through any method or means known in the art. For example, as shown in the illustrated embodiment, the portions may be coupled together with button detent connectors. A person of ordinary skill in the art, having the benefit of this disclosure, will recognize that any suitable connector, or connector means, including but not limited to a clip, a clamp, a detent, threads, or any combination thereof, may be used to couple the portions together.

Figure 3:
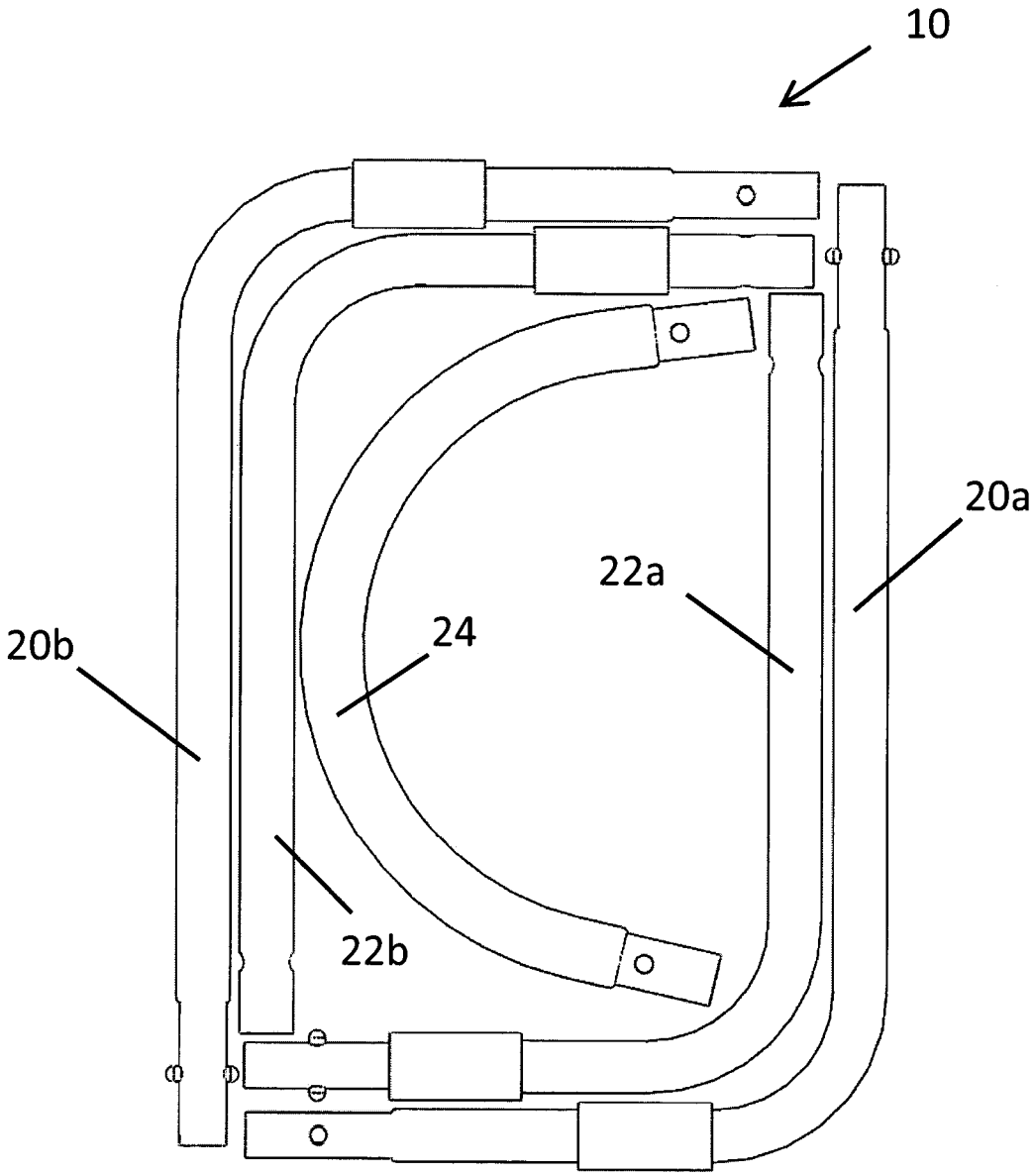
FIG. 3 is a top view of the collapsible mobility assistance device of FIG. 1 in a storage configuration.

Referring to FIGS. 2 and 3, in some embodiments, the mobility assistance device 10 may be broken down into common-sized portions (or components), which may thereby optimize the size of the packaging in which the mobility assistance device can be packaged, shipped, and/or stored. For example, in the illustrated embodiment the two base portions 22*a*, 22*b* are substantially equally sized, as are the two upright support portions 20*a*, 20*b*.

In some embodiments, the components of the mobility assistance device 10 may be sized and designed such that they may be disposed in specific storage configurations. For example, FIG. 3 specifically shows the pieces of the mobility assistance device 10 broken down and arranged in one particular storage configuration. As shown in FIG. 3, the mobility assistance device may be designed such that the two base portions 22*a*, 22*b*, the two upright support portions 20*a*, 20*b*, and the handle portion 24 may be oriented in a substantially rectangular, coplanar orientation when the device is in a storage configuration. In the embodiment of FIG. 3, the two upright support portions 20*a*, 20*b* are disposed such that they form an outermost rectangle, while the two base portions 22*a*, 22*b* are disposed such that they form a second rectangle within the outermost rectangle. In other embodiments, a rectangle formed by the two base portions 22*a*, 22*b* may be disposed outside a rectangle formed by the two upright support portions 20*a*, 20*b*. Furthermore, in some embodiments, the outermost and inner rectangles may each be formed by one base portion (22*a* or 22*b*) and one upright support portion (20*a* or 20*b*). In each and any of these exemplary embodiments, the handle portion 24 may be configured to be disposed within any of the rectangles.

In some embodiments, the configuration, size, and/or arrangement of the portions of the mobility assistance device 10 may allow the mobility assistance device 10 to be packaged in a container having a thickness only large enough to accommodate a single layer of pieces. For example, in the storage configuration illustrated in FIG. 3, no piece is disposed on top of, or underneath, any other piece. Thus, a container, such as a box, sized to accommodate the collapsible mobility assistance device 10 of FIG. 3 need only be thick enough to accommodate one layer of components. Similarly, a wide variety of storage configurations, such as those described in more detail above, may be designed such that a package configured to accommodate the portions need only be as thick as the thickest portion of the pieces.

In the embodiment shown in FIGS. 1-5, the base section 12 is separable into two portions 22*a*, 22*b*, and the upright section 14 is separable into three portions 20*a*, 20*b*, 24. Other configurations and combinations are within the scope of this disclosure. For example, a base section may be separable into three pieces, and an upright section may be separable into two pieces. In other embodiments, the base section and the upright section may be separable into other combinations of pieces. In these and other embodiments, the pieces may have a substantially common size, which may allow for compact packaging in some instances. Specifically, in certain embodiments, the two upright support portions 20*a*, 20*b* may be substantially the same size. In other embodiments, the two base portions 22*a*, 22*b* may also (or alternatively) be substantially the same size. Furthermore, in certain embodiments the two upright support portions 20*a*, 20*b* may be substantially the same size as the two base portions 22*a*, 22*b*, including embodiments where the two base portions 22*a*, 22*b* are exactly the same size, slightly larger, or slightly smaller than the two upright support portions 20*a*, 20*b*.

Furthermore, in the embodiment shown in FIGS. 1-5, each portion 20*a*, 20*b*, 22*a*, 22*b*, 24 of the mobility assistance device 10 is formed such that each individual portion is planar. In other words, each portion of the device 10 is configured such that the longitudinal axis of the portion lies substantially in a one plane. (As used in this sense, the longitudinal axis of a part refers to a collection of points along the center axis of the part, for example along the center of a substantially tubular part. This axis may not necessarily for a straight line, as the tubular parts may include bends, for example junction portions such as 18*a* and 18*b*.) Thus, each portion is able to "lie flat" in a box or on a flat surface. It will be appreciated by those skilled in the art, having the benefit of this disclosure, that a wide variety of configurations (including, for example, altering the location of joints between the portions, the number of portions into which the device may be separated, and the location of junctions and/or elbows and other bends) may be designed such that each individual part is planar. In some embodiments, the device may be designed with all planar portions such that each portion can simultaneously be substantially disposed in a single plane, for example, when the device is disposed in a storage configuration. In such embodiments, a suitable storage container may only need a thickness configured to accommodate parts with a maximum thickness equal to the outside diameter of the tubular parts.

Figure 6:
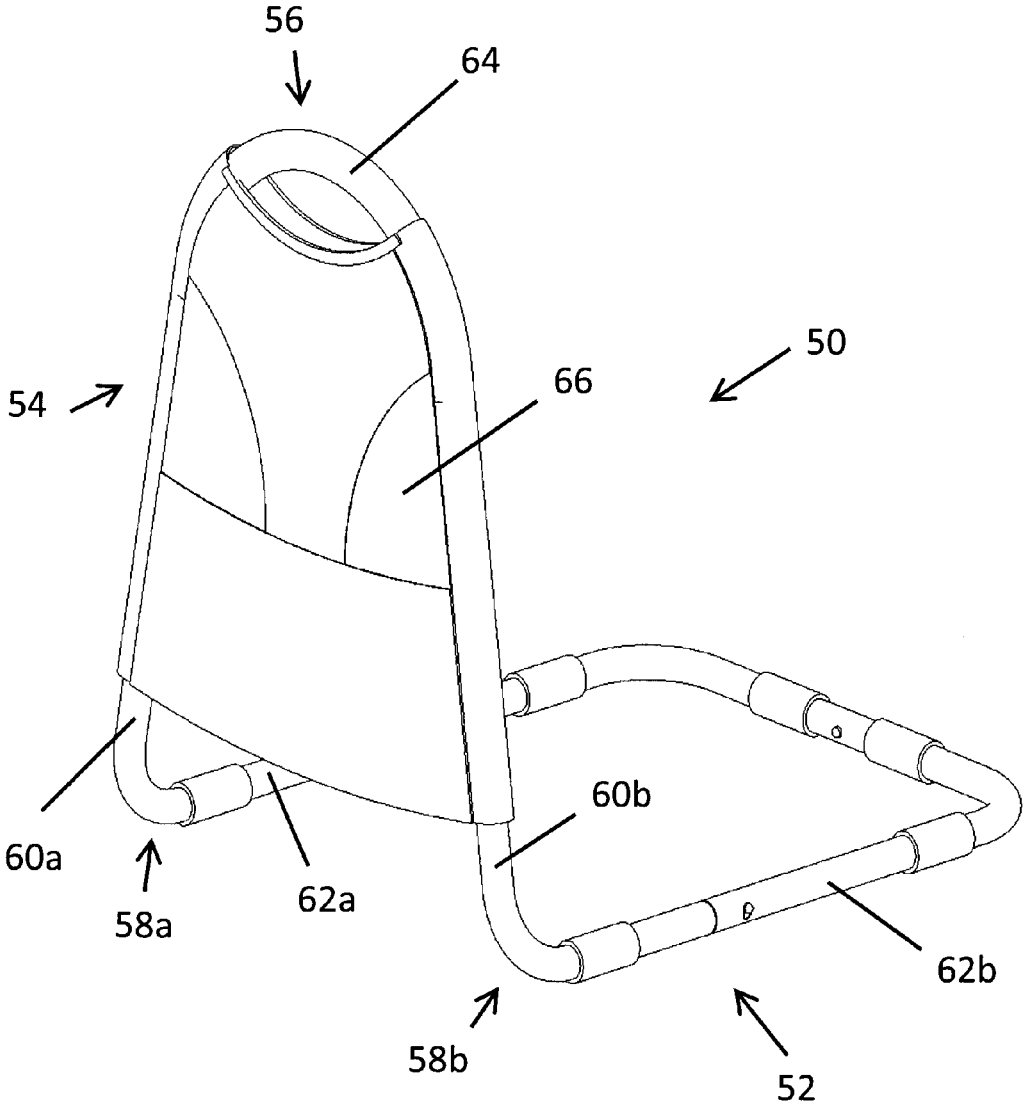
FIG. 6 is a perspective view of another embodiment of a collapsible mobility assistance device in an operative configuration.
Figure 7:
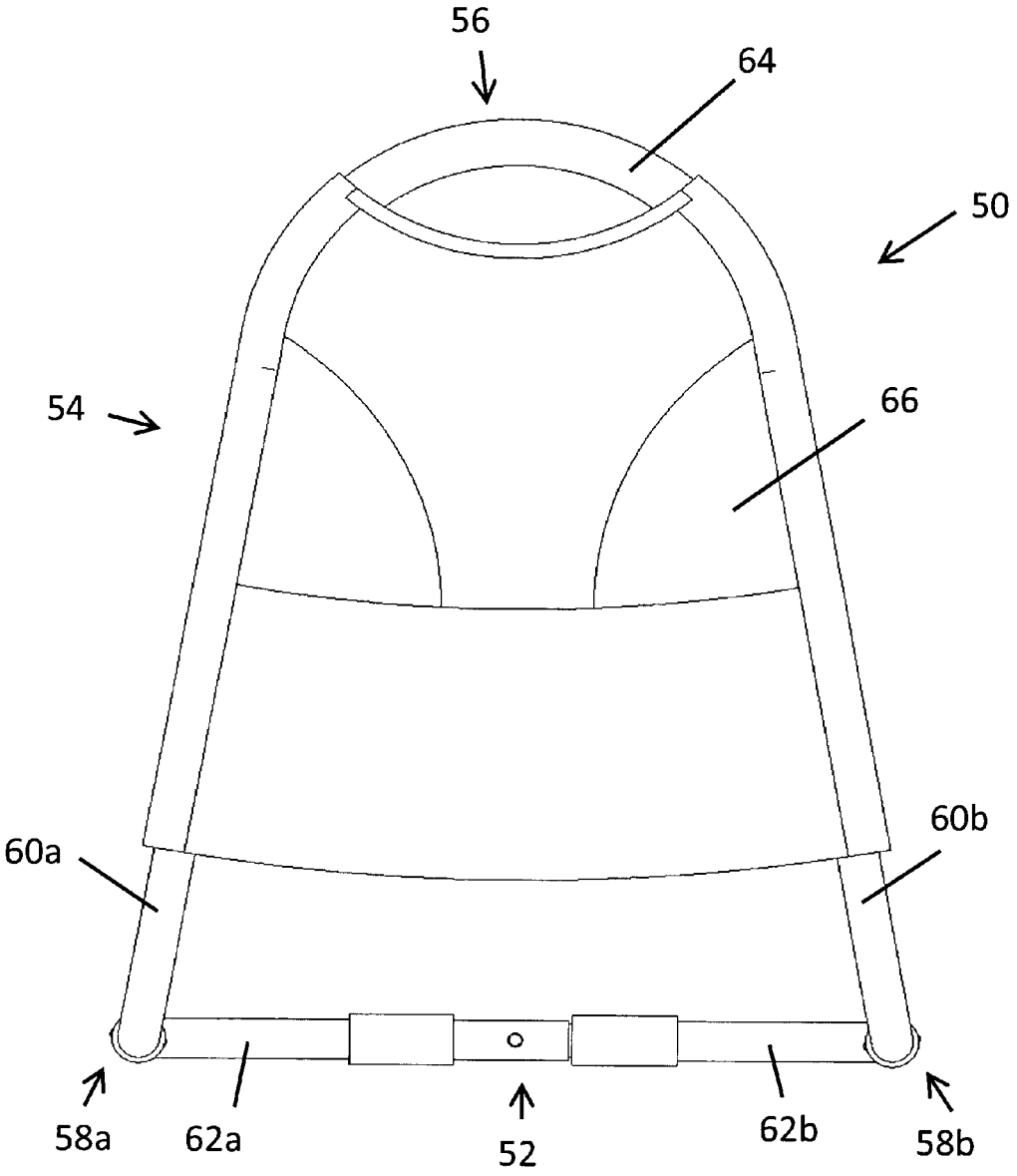
FIG. 7 is a front view of the collapsible mobility assistance device of FIG. 6.

FIGS. 6 and 7 illustrate another embodiment of a collapsible mobility assistance device 50. The collapsible mobility assistance device 50 of FIGS. 6 and 7 includes a base section 52 and an upright section 54 (which also includes a handle 56). The base section 52 may be separable into two base portions 62*a*, 62*b* while the upright section 54 may be separable into two upright support portions 60*a*, 60*b* and a handle portion 64. Further, the device 50 may include junction portions 58*a*, 58*b*. The collapsible mobility assistance device 50 of FIGS. 6 and 7 may, in certain respects, resemble the collapsible mobility assistance device 10 described in connection with FIGS. 1-5 above. It will be appreciated that all the illustrated embodiments have analogous features. Relevant disclosure set forth above regarding similarly identified features thus may not be repeated hereafter. Moreover, specific features of the collapsible mobility assistance device and related components shown in FIGS. 6 and 7 may not be shown or identified by a reference numeral in the drawings, or specifically discussed in the written description that follows. However, such features may clearly be the same, or substantially the same, as features depicted in other embodiments and/or described with respect to such embodiments. Accordingly, the relevant descriptions of such features apply equally to the features of the collapsible mobility assistance device of FIGS. 6 and 7. Any suitable combination of the features, and variations of the same, described with respect to the collapsible mobility assistance device and components illustrated in FIGS. 1-5 can be employed with the collapsible mobility assistance device and components of FIGS. 6 and 7, and vice versa.

Analogous to the embodiment of FIGS. 1-5, the collapsible mobility assistance device 50 of FIGS. 6 and 7 may be configured to be disposed in, at least, an operative configuration and a storage (packaged) configuration. The collapsible mobility assistance device 50 of FIGS. 6 and 7 may further include a pouch 66 configured to couple to the mobility assistance device 50. In some embodiments, the pouch 66 may be configured to provide a storage location, such as a pocket, on a device such as a bed rail. The pouch 66 may be removable from the collapsible mobility assistance device 50 in order to facilitate storage of the device 50. For instance, the pouch 66 may be designed with sleeves configured to fit over a portion of the collapsible mobility assistance device 50 such as the upright support portions 60*a*, 60*b*. In such embodiments, the pouch 66 may be held in place (due to, for example, friction between the sleeves and the upright support portions 60*a*, 60*b*) while the device 50 is in an operable configuration. Further, in such embodiments, the pouch 66 may be easily slipped off the upright support portions 60*a*, 60*b* when they are uncoupled from other portions of the device 50. The pouch 66 may be formed of relatively thin, flexible fabric such that it may easily be disposed within a package designed to accommodate the collapsible mobility assistance device 50, without necessitating a significant increase in the size of the package.

Without further elaboration, it is believed that one skilled in the art can use the preceding description to utilize the present disclosure to its fullest extent. The examples and embodiments disclosed herein are to be construed as merely illustrative and exemplary, and not a limitation of the scope of the present disclosure in any way. It will be apparent to those having skill in the art that changes may be made to the details of the above-described embodiments without departing from the underlying principles of the disclosure herein. It is intended that the scope of the invention be defined by the claims appended hereto and their equivalents.

The invention claimed is:

1. A collapsible mobility assistance device, having an operative configuration and a storage configuration, the collapsible mobility assistance device comprising:

a base section configured to be disposed under a cushion-type portion of a piece of furniture; and an upright section, the upright section comprising: a handle portion configured to be graspable by a user, a first upright support portion configured to couple the handle portion to the base section, and a second upright support portion configured to couple the handle portion to the base section;

wherein the base section is configured to couple to the first and second upright support portions and the handle portion is configured to removably couple to the first and second upright support portions, and the base section, handle portion, and first and second upright support portions are each substantially planar when in the storage configuration, wherein the base section is configured to be decoupleable, into a first base portion and a second base portion, and the first and second base portions, the first and second upright support portions, and the handle portion are configured to be oriented in a substantially rectangular, coplanar orientation when the device is in a storage configuration.

2. The collapsible mobility assistance device of claim 1, wherein the base section is decoupleable into two substantially equally sized components.

3. The collapsible mobility assistance device of claim 2, wherein each of the base section components includes a portion which forms a substantially 90 degree angle.

4. The collapsible mobility assistance device of claim 2, wherein the first upright support portion and the second upright support portion are substantially equally sized.

5. The collapsible mobility assistance device of claim 1, wherein the first and second upright support portions each include a portion which forms a substantially 90 degree angle.

6. The collapsible mobility assistance device of claim 1, further comprising a pouch configured to couple to the mobility assistance device.

7. The collapsible mobility assistance device of claim 1, wherein the distance between the first and second upright support portions is smaller near the handle portion than the distance between the first and second upright support portions near the base section, when the device is in an operative configuration.

8. The collapsible mobility assistance device of claim 1, wherein the first and second upright support portions collectively circumscribe a substantially rectangular shape and the first and second base portions and the handle portion fit within the rectangular shape.

9. The collapsible mobility assistance device of claim 1, wherein the first and second base portions collectively circumscribe a substantially rectangular shape and the first and second upright support portions and the handle portion fit within the rectangular shape.

10. The collapsible mobility assistance device of claim 1, wherein two of the first and second upright support portions and the first and second base portions collectively circumscribe a substantially rectangular shape and the other portions of the device fit within the rectangular shape.

11. The collapsible mobility assistance device of claim 1, wherein when the device is in the storage configuration, the first and second base portions, the first and second upright support portions, and the handle portion are sized such that they are packagable in flat, planar packaging having a thickness about as small as the thickness of each piece.

12. A collapsible mobility assistance device, having a storage configuration and an operative configuration, the collapsible mobility assistance device comprising:

a base section configured to be disposed underneath a cushion-type portion of furniture, the base section comprising, a first base portion configured to be releasably coupled to a second base portion, wherein the first base portion and second base portion are of substantially equal sizes; and an upright section comprising, a handle portion configured to be graspable by a user, a first upright support portion configured to releasably couple to the handle portion and to the base section, and a second upright support portion configured to releasably couple to the handle portion and to the base section, wherein the first upright support portion and the second upright support portion are of substantially equal sizes, and wherein the first and second base portions, the first and second upright support sections, and the handle portion are each substantially planar when the device is in the storage configuration, wherein the first and second base portions, the first and second upright support portions, and the handle portion are configured to be oriented in a substantially rectangular, coplanar orientation when the device is in a storage configuration.

13. The collapsible mobility assistance device of claim 12, wherein the first upright support portion and the second upright support portion are not parallel when the collapsible mobility device is in an operative configuration, such that the distance between the first and second upright support portions is smaller near the handle portion than the distance between the first and second upright support portions near the base section.

14. The collapsible mobility assistance device of claim 12, wherein each of the base section portions includes a portion which forms a substantially 90 degree angle.

15. The collapsible mobility assistance device of claim 12, wherein the first and second upright support portions each include a portion which forms a substantially 90 degree angle.

16. The collapsible mobility assistance device of claim 12, wherein when the device is in the storage configuration, the first and second base portions, the first and second upright support portions, and the handle portion are sized such that they can be packaged in flat, planar packaging having a thickness of a single piece and wherein each piece has the same thickness.

17. A method of packaging or storing a collapsible mobility assistance device, comprising:

obtaining a collapsible mobility assistance device, the device having a storage configuration and an operative configuration, the collapsible mobility assistance device comprising:

a base section configured to be disposed underneath a cushion-type portion of furniture, the base section comprising, a first base portion configured to be releasably coupleable to a second base portion; and an upright section comprising, a handle portion configured to be graspable by a user, a first upright support portion configured to releasably couple to the handle portion and to the base section, and a second upright support portion configured to releasably couple to the handle portion and to the base section;

wherein the first and second base portions, the first and second upright support portions, and the handle portion are substantially planar when the device is in the storage configuration; and placing the first base portion, the second base portion, the first upright support portion, the second upright support portion, and the handle portion in a container such that no component rests on top of another component, wherein the container has a thickness about the same as the thickness of the first base portion and the second base portion.

18. The method of claim 17, wherein the first base portion, the second base portion, the first upright support portion, and the second upright support portion are placed in the container such that they collectively circumscribe one or more rectangles which surround the handle portion.

19. The method of claim 17, wherein the first and second upright support portions collectively circumscribe a substantially rectangular shape and the first and second base portions and the handle portion fit within the rectangular shape.

20. The method of claim 17, wherein the first and second base portions collectively circumscribe a substantially rectangular shape and the first and second upright support portions and the handle portion fit within the rectangular shape.

* * * * *